US008035319B2

(12) United States Patent
Zhang et al.

(10) Patent No.: US 8,035,319 B2
(45) Date of Patent: Oct. 11, 2011

(54) VOLTAGE SENSING APPARATUS FOR POWER REGULATION AND OVER-VOLTAGE PROTECTION OF DISCHARGE LAMP AND METHOD THEREOF

(75) Inventors: Weigiang Zhang, Shanghai (CN); Qi Zhang, Shanghai (CN); Jianping Ying, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 390 days.

(21) Appl. No.: 12/403,809

(22) Filed: Mar. 13, 2009

(65) Prior Publication Data

US 2009/0230889 A1 Sep. 17, 2009

(30) Foreign Application Priority Data

Mar. 17, 2008 (TW) ..... 97109389 A

(51) Int. Cl.
*G05F 1/00* (2006.01)
*H05B 37/02* (2006.01)
*H05B 39/04* (2006.01)
*H05B 41/36* (2006.01)

(52) U.S. Cl. ..... 315/307; 315/224; 315/291; 315/209 R

(58) Field of Classification Search ..... 315/224–226, 315/291, 209 R, 307–308, DIG. 5, DIG. 7
See application file for complete search history.

(56) References Cited

U.S. PATENT DOCUMENTS

2007/0210723 A1* 9/2007 Kumagai et al. ..... 315/209 M
2009/0273295 A1* 11/2009 Henry et al. ..... 315/246
2010/0084988 A1* 4/2010 Nagata et al. ..... 315/246

* cited by examiner

*Primary Examiner* — Anh Tran

(57) ABSTRACT

The configurations of a discharge lamp system and a controlling method thereof are provided in the present invention. The proposed discharge lamp system includes a discharge lamp, a converter circuit coupled to the discharge lamp and having a switching switch, a ballast controller generating a first driving signal and controlling the switching switch accordingly, and a voltage sensing apparatus receiving the first driving signal and generating a sensed voltage accordingly, wherein the discharge lamp is switched among a plurality of operating modes according to the sensed voltage.

19 Claims, 7 Drawing Sheets

VOLTAGE SENSING APPARATUS FOR POWER REGULATION AND OVER-VOLTAGE PROTECTION OF DISCHARGE LAMP AND METHOD THEREOF

FIELD OF THE INVENTION

The present invention relates to a ballast circuit supplying power to a discharge lamp having a voltage sensing apparatus and a controlling method thereof, which can be applied to achieve the power regulation and the over-voltage protection of the discharge lamp.

BACKGROUND OF THE INVENTION

The high-intensity discharge (HID) lamps have been widely used in many applications because of their high efficiency, good color rendering and long life span. However, the HID lamp is a complex load, the lamp parameters (voltage, current, power etc.) frequently change during its operation time. FIG. 1 shows a typical control strategy for the discharge lamps in the prior art. After ignition, the discharge lamp is usually operated at a constant current mode during a run-up stage and the discharge lamp power increases gradually with the increasing of discharge lamp voltage ($V_{lamp}$). When the discharge lamp voltage is higher than a first predetermined value V1 the discharge lamp power enters a stable working status—a constant power stage so as to attain better discharge lamp performance. The discharge lamp is judged to be at the end of its life when its voltage is higher than a second predetermined value V2, and it is switched off when its voltage is higher than a specified value. Therefore, a special power supply named ballast is then needed for these discharge lamps. FIG. 2 shows a block diagram of the ballast circuit for a HID lamp with power factor correction (PFC) circuit as the first stage in the prior art. And the second stage—the DC/AC inverter, inverts the output of the PFC circuit to a voltage required by the HID lamp. The controller adopts proper control method so as to realize the typical control strategy shown in FIG. 1. Besides, in FIG. 2, the ballast circuit further includes an AC power source, an electromagnetic interference (EMI) filter and a rectifier, wherein the EMI filter receives the AC power source and the rectifier connected between the EMI filter and the PFC circuit.

FIG. 3 shows a schematic circuit diagram of a ballast circuit in the prior art, in which only the DC/AC inverter of the second stage, the controller and the discharge lamp are shown. And the DC/AC inverter is a half-bridge circuit acting as a double down-converter. The double down-converter includes a first MOSFET S1, a second MOSFET S2, a first and a second body diodes D1 and D2, an inductor L2 connected to the discharge lamp in series, a capacitor C2 connected to the discharge lamp in parallel and two electrolytic bridge capacitors CH1 and CH2 connected in series. The double down-converter is operated in the critical continuous mode with the controller, e.g., L6562. In each half commutation period (commutation frequency is in the order of 100 Hz), one MOSFET (S1 or S2) operates in higher frequency, e.g., 100 kHz, in combination with the diode (D2 or D1) of the other MOSFET as a Buck converter. The resistive divider of R1 and R2 is used to sense the value of discharge lamp voltage. C3 acts as a noise filter. Equation (1) shows the relationship between the sensed discharge lamp voltage VC and the real discharge lamp voltage $V_{lamp}$.

$$VC=(V_{DC}/2\pm V_{lamp})*R2/(R1+R2) \quad (1),$$

$V_{DC}$ is the output voltage of the PFC circuit, and $V_{lamp}$ is the discharge lamp voltage.

Based on the sensed discharge lamp voltage VC, the micro controller unit (MCU) then outputs a control signal to a first controller—the DCMB (discontinuous conduction mode boundary) controller to adjust the duty ratio of the driving signal of the MOSFET S1 and S2 so as to achieve the power regulating and the detection of end of the life according to the typical lamp control strategy.

One major drawback of the prior art is that the resistive voltage divider suffers from high voltage stress. And the usage of the resistive voltage divider increases the cost and reduces the power density of the ballast converter. As can be seen, before the lamp ignition, the maximum voltage across resistors R1 and R2 equals to the voltage $V_{lamp}$ plus half of the voltage $V_{DC}$ of the output of the PFC circuit. Assuming that $V_{DC}$=450V, then $V_{lamp}$=225V (generally before ignition $V_{lamp}=V_{DC}/2$), therefore, the resistive voltage divider have to endure a voltage rating of at least 450V.

From the above analysis, a new scheme is then needed to overcome the drawbacks of the prior art for sensing the discharge lamp voltage.

Keeping the drawbacks of the prior arts in mind, and employing experiments and research full-heartily and persistently, the applicant finally conceived a voltage sensing apparatus for the power regulation and the over-voltage protection of a discharge lamp system and a controlling method thereof.

SUMMARY OF THE INVENTION

It is therefore an object of the present invention to provide a discharge lamp system having a voltage sensing apparatus and a controlling method thereof, which employs a resistor-capacitor (RC) filter to obtain a duty ratio of a switch driving signal of a discharge lamp ballast circuit to sense a discharge lamp voltage indirectly, can be applied to the power regulation and the over-voltage protection of the discharge lamp, and the provided voltage sensing apparatus possesses the advantages of having lower cost, higher reliability and smaller sizes since the rated voltage of the switch driving signal received by the RC filter is relatively lower.

According to the first aspect of the present invention, a ballast circuit supplying power to a discharge lamp includes a first circuit having a first switch and a controller circuit including a first controller outputting a first driving signal controlling the first switch and a voltage sensing apparatus receiving the first driving signal and generating a sensed voltage representing a duty ratio of the first driving signal and reflecting a discharge lamp voltage, wherein the discharge lamp switches among a plurality of operating modes according to the sensed voltage.

Preferably, the discharge lamp is a high-intensity discharge (HID) lamp.

Preferably, the discharge lamp switches among a constant current mode, a constant power mode and a turn-off mode according to the sensed voltage.

Preferably, the voltage sensing apparatus includes a resistor having a first terminal receiving the first driving signal and a second terminal and a capacitor having a first terminal connected to the second terminal of the resistor and outputting the sensed voltage.

Preferably, the first circuit is an inverter circuit having the first and a second switches.

Preferably, the controller circuit further comprises a micro controller unit (MCU) and a driver, wherein the MCU receives the sensed voltage and generates a control signal, the first controller receives the control signal and outputs the first driving signal, and the driver receives the first driving signal and outputs a second and a third driving signals driving the first and the second switches respectively.

Preferably, the first controller is a digital controller, the controller circuit further includes a driver, the digital controller receives the sensed voltage and generates the first driving signal, and the driver receives the first driving signal and outputs a second and a third driving signals driving the first and the second switches respectively.

Preferably, the circuit further includes an AC power source, an electromagnetic interference (EMI) filter, a rectifier and a power factor correction (PFC) circuit, wherein the first circuit is an inverter circuit, the EMI filter receives the AC power source, the rectifier is connected between the EMI filter and the PFC circuit, and the inverter circuit includes the first switch and receives an output of the PFC circuit.

Preferably, the circuit further includes an AC power source, an electromagnetic interference (EMI) filter, a rectifier, a power factor correction (PFC) circuit and an inverter circuit, wherein the first circuit is a DC/DC converter having the first switch, the EMI filter receives the AC power source, the rectifier is connected between the EMI filter and the PFC circuit, the DC/DC converter receives an output of the PFC circuit and the inverter circuit receives an output of the DC/DC converter.

Preferably, the DC/DC converter is a buck converter and the inverter circuit is a full-bridge inverter.

According to the second aspect of the present invention, a controlling method for a ballast circuit supplying power to a discharge lamp, wherein the ballast circuit comprises a first circuit having a first switch, and a controller circuit comprising a first controller and a voltage sensing apparatus, includes steps of: causing the first controller to generate a first driving signal so as to control the first switch; causing the voltage sensing apparatus to receive the first driving signal and generate a sensed voltage representing a duty ratio of the first driving signal reflecting the discharge lamp voltage; and switching an operating mode of the discharge lamp according to the sensed voltage.

Preferably, the switching step further includes a step of: working under a constant power mode when the sensed voltage is larger than a first predetermined value.

Preferably, the switching step further includes a step of: turning off the discharge lamp when the sensed voltage is larger than a second predetermined value.

Preferably, the switching step further includes a step of: working under a constant current mode when the sensed voltage is smaller than a third predetermined value.

Preferably, the third predetermined value equals to the first predetermined value.

Preferably, the signal reflects a lamp voltage of the discharge lamp and the first controller is a digital controller.

Preferably, the method further includes a step of: causing the driver to generate a second and a third driving signals to drive the first and the second switches respectively.

According to the third aspect of the present invention, a ballast circuit supplying power to a discharge lamp includes a first circuit having a switch, a first controller generating a first driving signal controlling the switch accordingly, and a voltage sensing apparatus receiving the first driving signal and generating a sensed voltage accordingly, wherein the sensed voltage reflects a discharge lamp voltage and the discharge lamp switches among a plurality of operating modes according to the sensed voltage.

The present invention may best be understood through the following descriptions with reference to the accompanying drawings, in which:

DETAILED DESCRIPTION OF THE PREFERRED EMBODIMENT

Figure 4A:
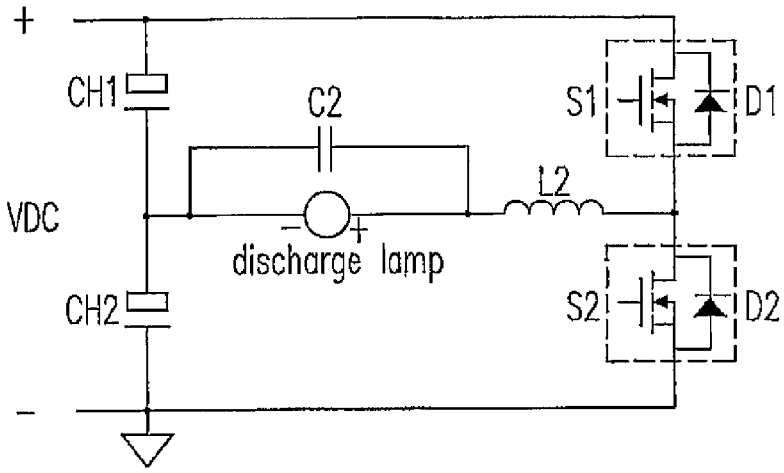
FIGS. 4(*a*)-4(*b*) respectively show schematic circuit diagrams of a DC/AC inverter and a controller circuit of a ballast circuit according to the first preferred embodiment of the present invention.
Figure 4B:
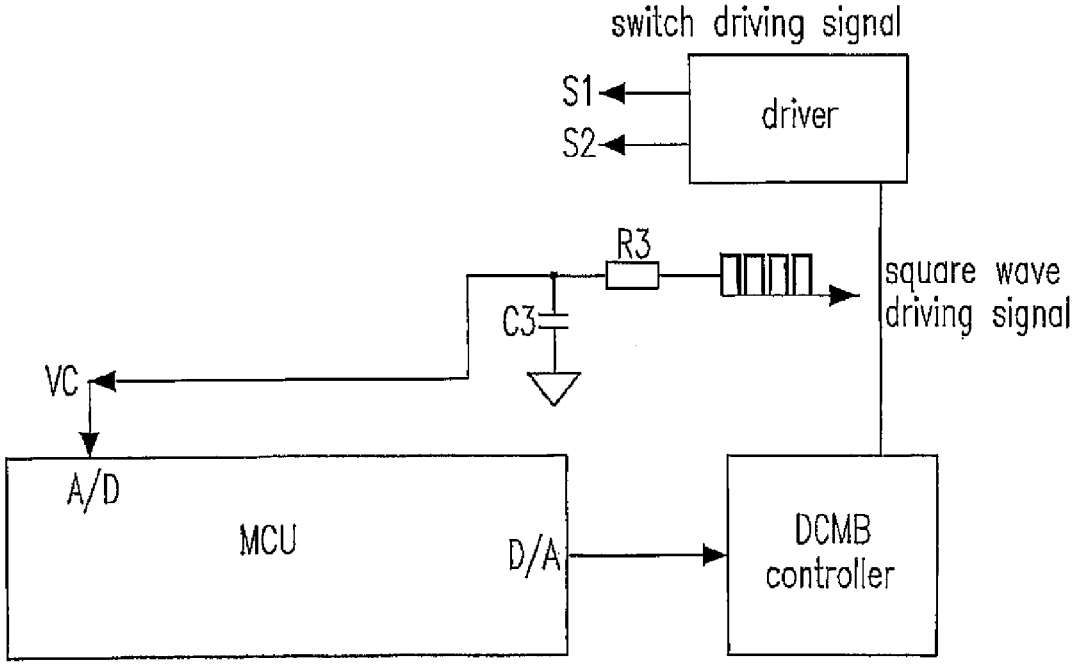

In FIGS. 4(*a*)-4(*b*), schematic circuit diagrams of a DC/AC inverter and a controller circuit of a ballast circuit according to the first preferred embodiment of the present invention are shown respectively. In FIG. 4(*a*), only the DC/AC inverter of the second stage of the ballast circuit, the discharge lamp and the controller circuit are shown. The DC/AC inverter is a half-bridge circuit acting as a double down-converter. The double down-converter circuit includes a first MOSFET S1, a second MOSFET S2, a first and second body diodes D1 and D2, an inductor L2 connected in series with the discharge lamp, a capacitor C2 connected in parallel with the discharge lamp, and two electrolytic bridge capacitors CH1 and CH2 connected in series. The double down-converter circuit operates in the critical continuous mode with the controller, e.g., L6562. As shown in FIG. 4(*b*), the controller circuit includes an RC filter having a resistor R3 and a capacitor C3 wherein the resistor R3 having a first terminal to receiving a first driving signal (in the first preferred embodiment, it is a square wave driving signal) and a second terminal connected to a first terminal of the capacitor C3, a MCU having an analog-to-digital input terminal A/D and a digital-to-analog output terminal D/A, a first control circuit DCMB (discontinuous conduction mode boundary) controller generating the first driving signal, and a driver receiving the first driving signal and generating a second and a third driving signals (in the first preferred embodiment, they are switch driving signals of S1 and S2). The duty ratio of the square wave driving signal generated by the DCMB controller reflects the value of the discharge lamp voltage $V_{lamp}$. Under the DCMB condition, based on the voltage-second balance theory, the following relation can be obtained:

$$(V_{DC}/2-V_{lamp})*\text{duty ratio}=(V_{DC}/2+V_{lamp})*(1-\text{duty ratio}) \quad (2)$$

Therefore, the relationship between the discharge lamp voltage and the duty ratio is rewritten in equation (3).

$$\text{duty ratio}=0.5+V_{lamp}/V_{DC} \quad (3)$$

After the aforementioned RC filter (R3/C3) receives and filters the square wave driving signal the discharge lamp voltage can be sensed indirectly. Since the voltage magnitude of the driving signal is usually a low voltage e.g. 15V, so the RC filter is very simple and low cost. With this indirectly sensing method, the cost reduction, high reliability and small sizes of the voltage sensing apparatus can all be achieved.

In the above-mentioned first preferred embodiment, the double down-converter operates in the DCMB mode. This indirect sampling method can also be applied on the other converter operates in other mode only if the definite relationship between the switch duty cycle and the discharge lamp voltage exists. For example, when the double down-converter operates in the continuous conduction mode (CCM) mode, the relationship between the switch duty cycle and the lamp voltage can also be expressed by equation (3), thus the indirect sampling method can also be used.

Figure 5A:
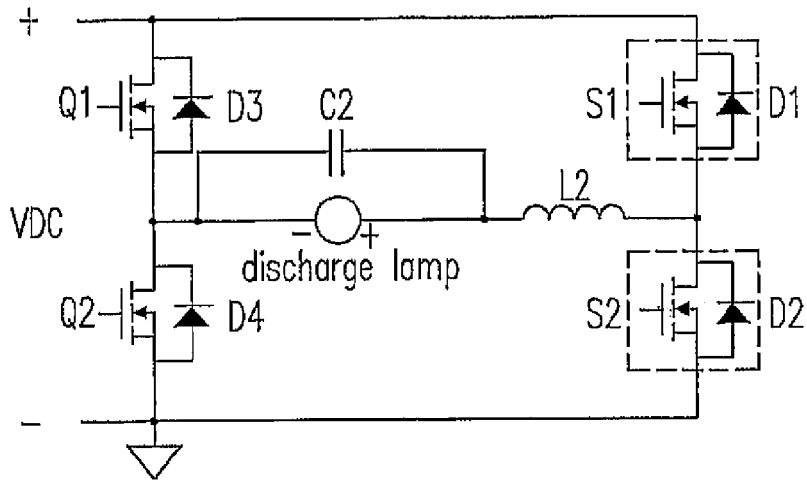
FIGS. 5(*a*)-5(*b*) respectively show schematic circuit diagrams of a DC/AC inverter and a controller circuit of a ballast circuit according to the second preferred embodiment of the present invention.
Figure 5B:
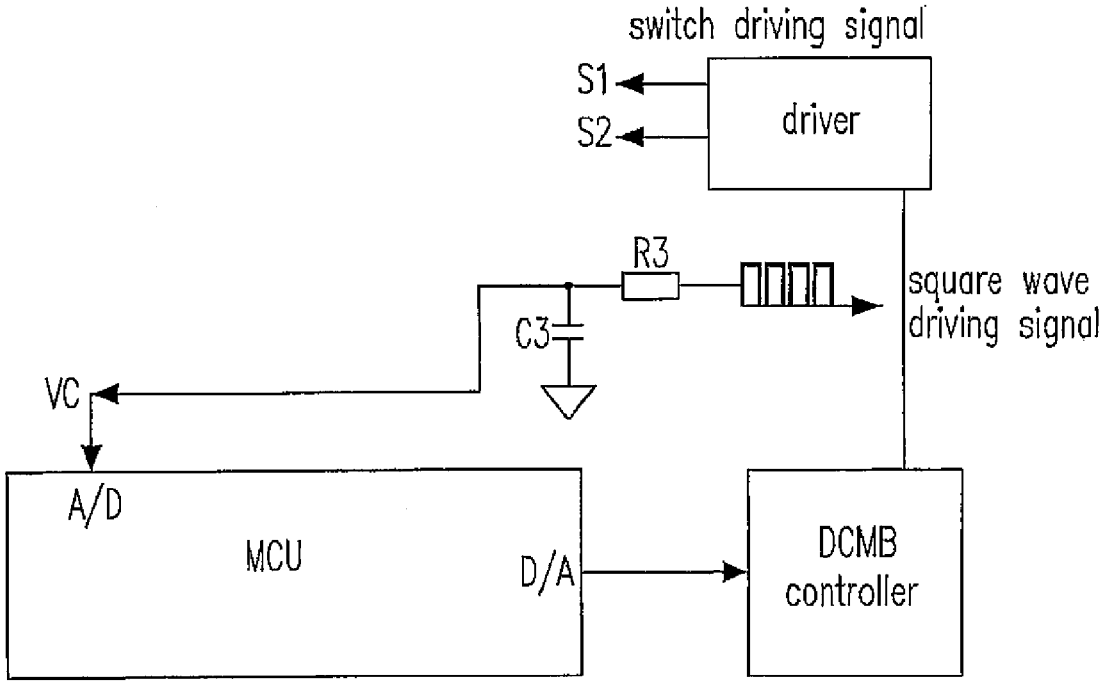

FIGS. 5(*a*)-5(*b*) show schematic circuit diagrams of a DC/AC inverter and a controller circuit of a ballast circuit for the HID lamp according to the second preferred embodiment of the present invention respectively. In FIG. 5(*a*), the two electrolytic bridge capacitors CH1 and CH2 as shown in FIG. 4(*a*) are replaced by two MOSFETs Q1 and Q2 and their body diodes D3 and D4. The remaining portions of FIGS. 5(*a*)-5(*b*) are the same as those of FIGS. 4(*a*)-4(*b*). And the two MOSFETs Q1 and Q2 operate at lower frequency, e.g., the commutation frequency, while the two MOSFETs S1 and S2 operate at higher frequency.

Figure 1:
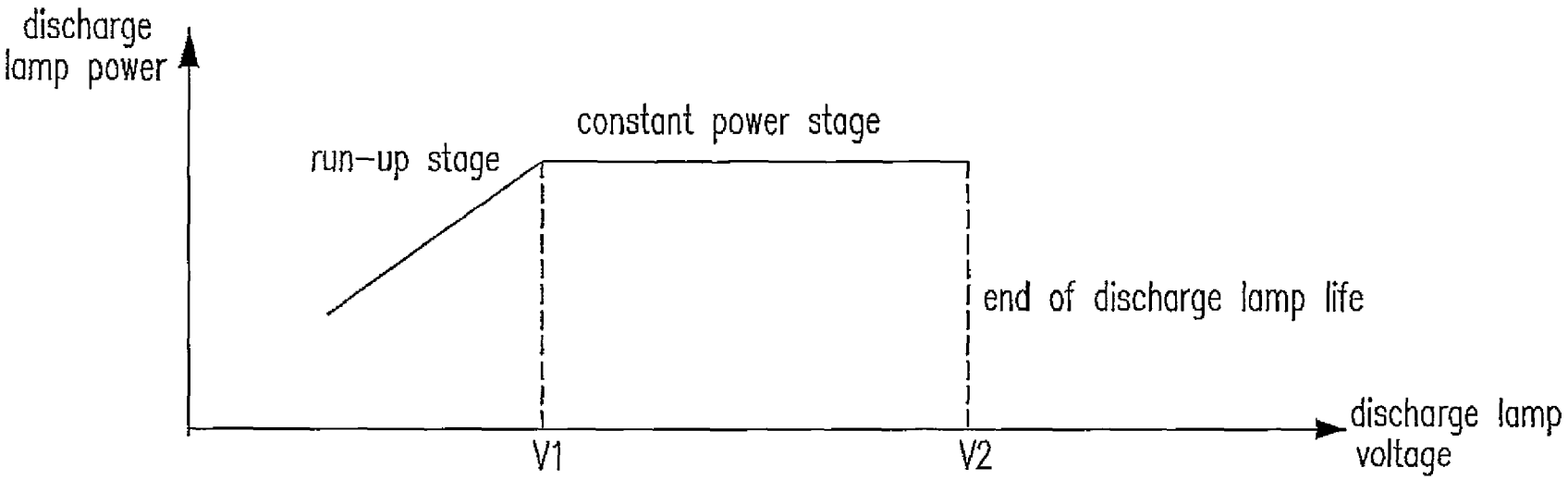
Fig. 1 (Prior Art)
FIG. 1 shows a typical control strategy for the discharge lamps in the prior art.
Figure 2:
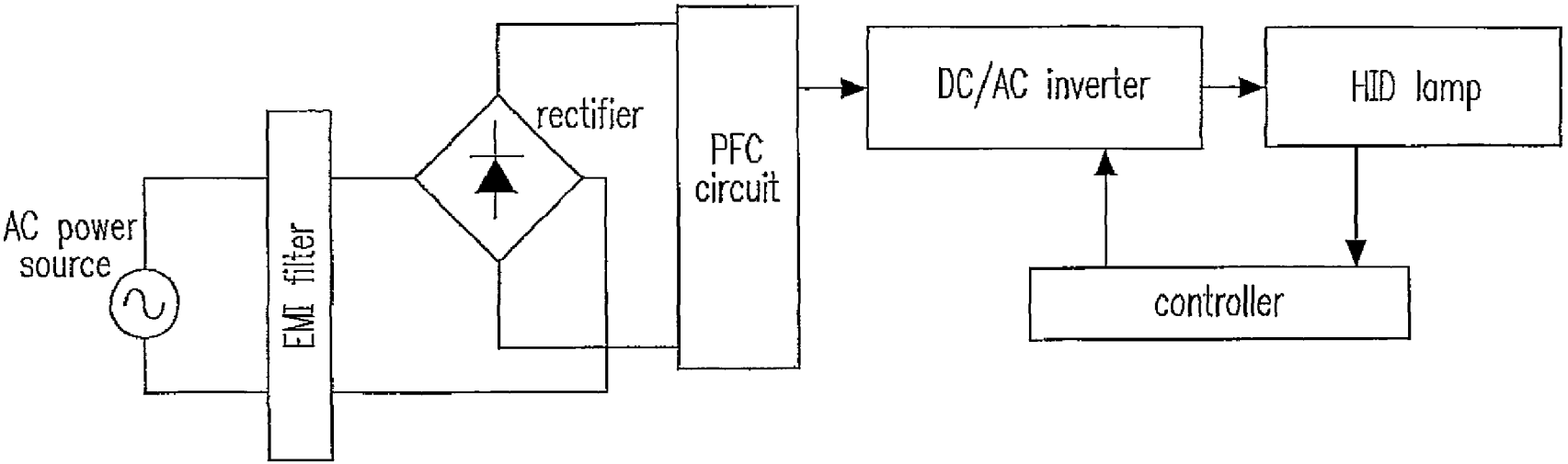
Fig. 2(Prior Art)
FIG. 2 shows a block diagram of a ballast circuit with a PFC circuit as the first stage in the prior art.
Figure 3:
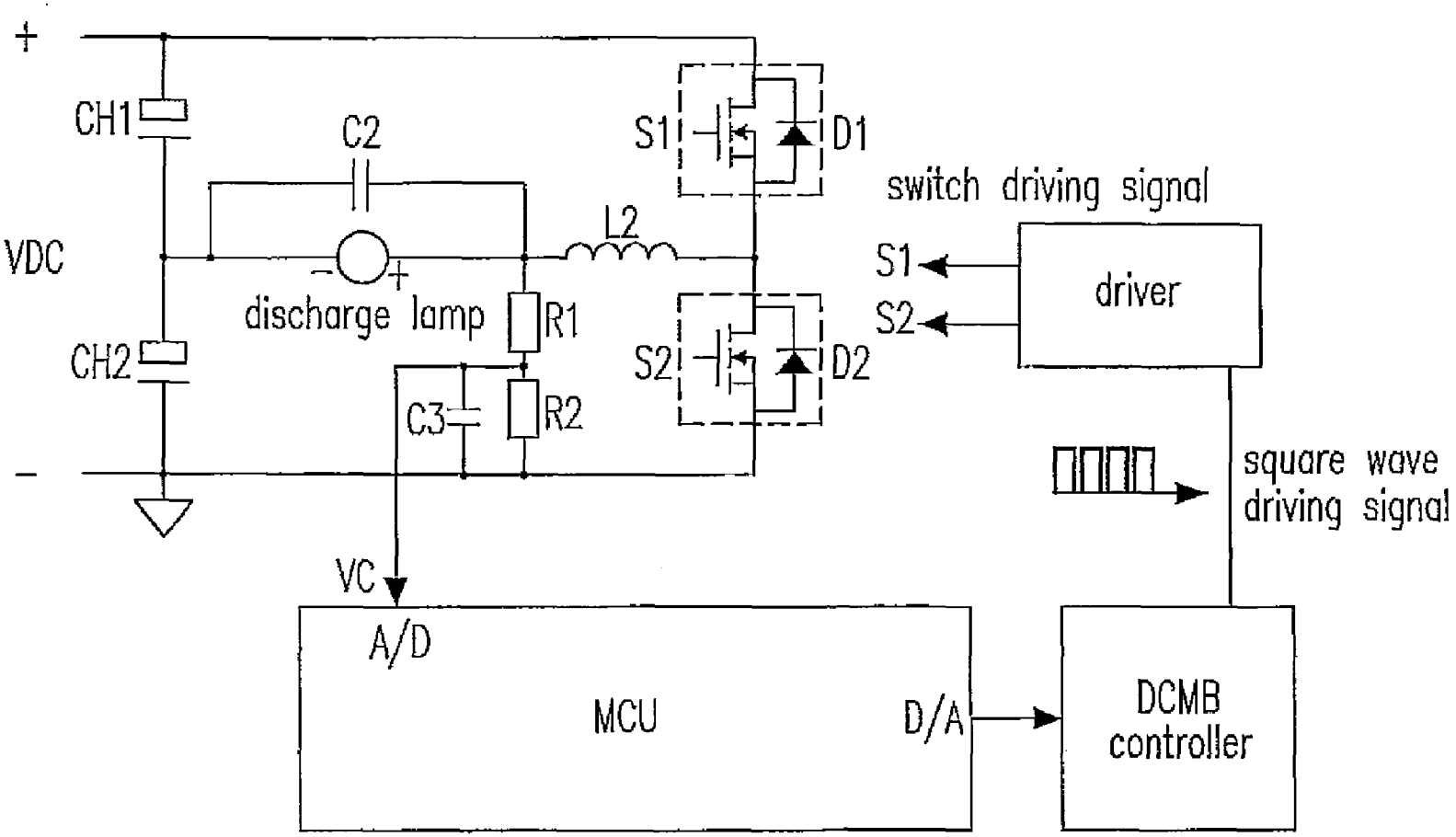
Fig. 3(Prior Art)
FIG. 3 shows a schematic circuit diagram of a ballast circuit in the prior art.
Figure 6A:
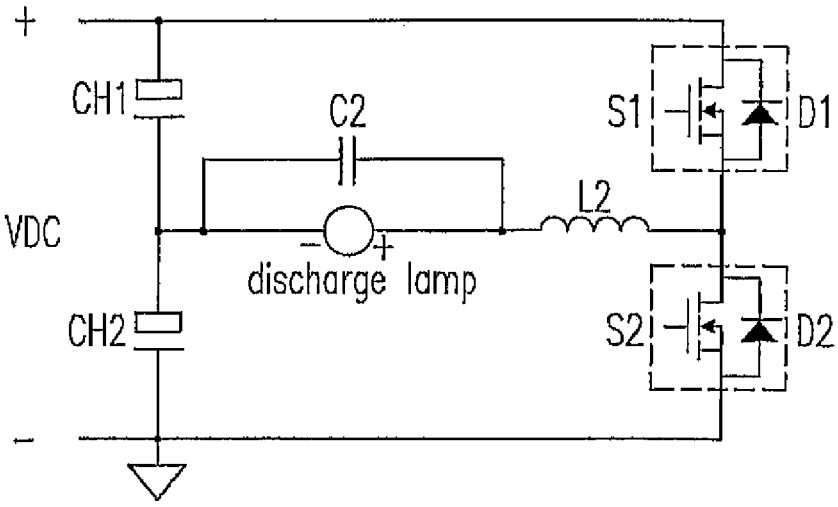
FIGS. 6(*a*)-6(*b*) respectively show schematic circuit diagrams of a DC/AC inverter and a controller circuit of a ballast circuit according to the third preferred embodiment of the present invention.
Figure 6B:
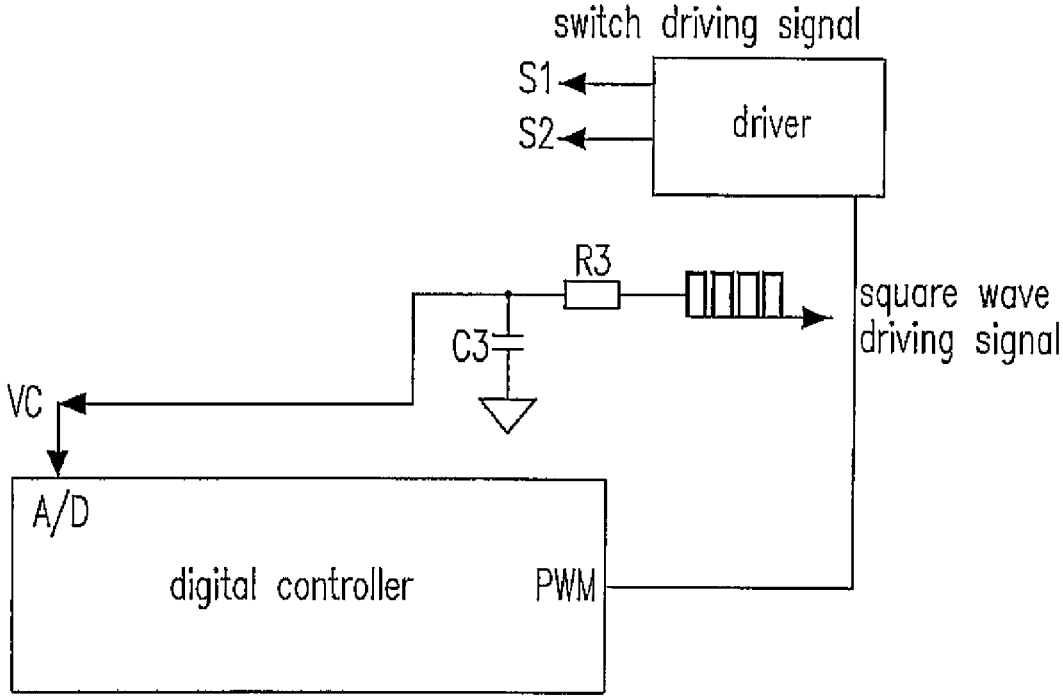

In the above-mentioned first and second preferred embodiments, the second stage of the ballast converter circuit operates under the analog control method. In fact, some ballast circuits adopt the totally digital control method as shown in FIGS. 6(*a*)-6(*b*). FIGS. 6(*a*)-6(*b*) show schematic circuit diagrams of a DC/AC inverter and a controller circuit of a ballast according to the third preferred embodiment of the present invention respectively. The schematic circuit diagram of the DC/AC inverter as shown in FIG. 6(*a*) is the same as that of FIG. 4(*a*). The MCU and the DCMB controller shown in FIGS. 4(*b*) and 5(*b*) are replaced by a digital controller in FIG. 6(*b*), wherein the digital controller having an analog-to-digital input terminal A/D and a pulse-width modulation output terminal PWM. In FIG. 6(*b*), the digital controller calculates and outputs the square driving signal to control S1 and S2 according to the typical control strategy for the discharge lamps shown in FIG. 1. Surely, the digital controller as shown in FIG. 6(*b*) can also directly attain the signal reflecting the discharge lamp voltage $V_{lamp}$ via calculating the duty ratio of the switch driving signals of S1 and S2 instead of getting the discharge lamp voltage $V_{lamp}$ by sensing the square wave signal via the voltage sensing apparatus R3 and C3. Thus, the proposed indirect lamp voltage sensing method can also be used under digital control.

Figure 7A:
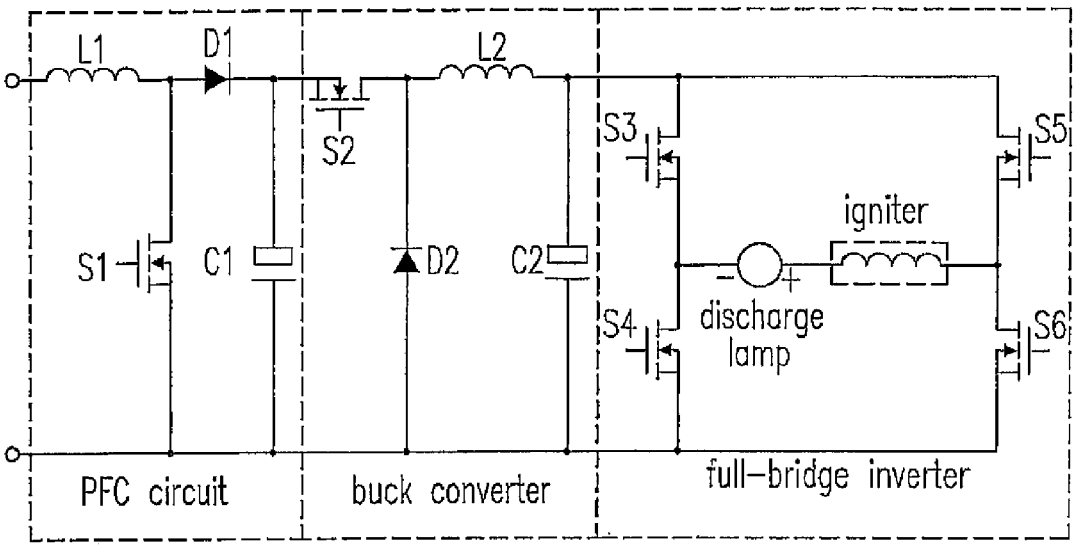
FIGS. 7(*a*)-7(*b*) respectively show schematic circuit diagrams of a ballast circuit and a controller circuit according to the fourth preferred embodiment of the present invention.
Figure 7B:
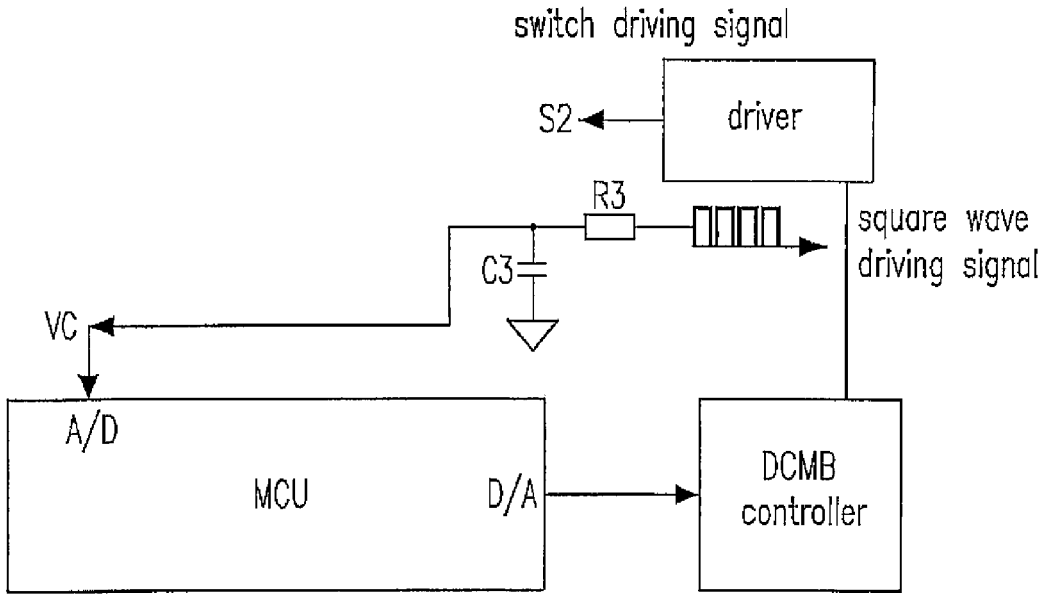

FIGS. 7(*a*)-7(*b*) show schematic circuit diagrams of a ballast converter circuit and a controller circuit according to the fourth preferred embodiment of the present invention respectively. In FIG. 7(*a*), the ballast converter circuit is a three-stage converter, which includes a PFC circuit, a buck converter and a full-bridge inverter. The PFC circuit includes an inductor L1, a switch S1, a diode D1 and a capacitor C1. The buck converter includes an inductor L2, a switch S2, a diode D2 and a capacitor C2. The full-bridge inverter includes switches S3-S6 and an igniter. The basic configuration of FIG. 7(*b*) is the same as those of FIGS. 4(*b*) and 5(*b*), and the only difference is that a DCMB controller, e.g. L6562, controls the buck converter instead of the full-bridge inverter. In the prior art, the discharge lamp voltage is attained by sensing the voltage across capacitor C2 in FIG. 7(*a*). And since the duty ratio of the driver of the switch S2 has a certain relationship with the voltage across C2, the discharge lamp voltage can be indirectly sensed through the duty ratio of S2. Surely, the configuration of FIG. 7(*b*) can also be the same as that of FIG. 6(*b*).

In the above-mentioned first to third preferred embodiments, the DC/AC inverter accepts the constant output voltage of the PFC circuit as its input. In fact, the output voltage of the PFC circuit can also be varied, e.g., having a higher output voltage during the ignition state for easier ignition and a lower output voltage for high efficiency of the DC/AC inverter in the normal operation mode or causing the output voltage of the PFC circuit to vary in proportional to the input voltage of the PFC circuit. And since the relationship between the duty cycle of switches and the discharge lamp voltage can still be expressed, this indirect sampling method can still be adopted.

According to the aforementioned descriptions, the present invention provides a ballast converter having a voltage sensing apparatus and a controlling method thereof, which employs an RC filter to obtain a duty ratio of a switch driving signal of the ballast circuit to sense a discharge lamp voltage indirectly so as to achieve the power regulation and the overvoltage protection of the discharge lamp. And the provided voltage sensing apparatus possesses the advantages of lower cost, higher reliability and smaller sizes since the rated voltage of the switch driving signal received by the RC filter is relatively lower. Thus, the present invention indeed possesses the non-obviousness and the novelty.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. A ballast circuit supplying power to a discharge lamp, comprising:

a first circuit having a first switch; and a controller circuit, comprising:

a first controller outputting a first driving signal controlling the first switch; and a voltage sensing apparatus receiving the first driving signal and generating a sensed voltage representing a duty ratio of the first driving signal reflecting a discharge lamp voltage, wherein the discharge lamp switches among a plurality of operating modes according to the sensed voltage.

2. A ballast circuit according to claim 1, wherein the discharge lamp is a high-intensity discharge (HID) lamp.

3. A ballast circuit according to claim 1, wherein the discharge lamp switches among a constant current mode, a constant power mode and a turn-off mode according to the sensed voltage.

4. A ballast circuit according to claim 1, wherein the voltage sensing apparatus comprises:

a resistor having a first terminal receiving the first driving signal and a second terminal; and a capacitor having a first terminal connected to the second terminal of the resistor and outputting the sensed voltage.

5. A ballast circuit according to claim 1, wherein the first circuit is an inverter circuit having the first and a second switches.

6. A ballast circuit according to claim 5, the controller circuit further comprises a micro controller unit (MCU) and a driver, wherein the MCU receives the sensed voltage and generates a control signal, the first controller receives the control signal and outputs the first driving signal, and the driver receives the first driving signal and outputs a second and a third driving signals driving the first and the second switches respectively.

7. A ballast circuit according to claim 5, wherein the first controller is a digital controller, the controller circuit further comprises a driver, the digital controller receives the sensed voltage and generates the first driving signal, and the driver receives the first driving signal and outputs a second and a third driving signals driving the first and the second switches respectively.

8. A ballast circuit according to claim 1 further comprising an AC power source, an electromagnetic interference (EMI) filter, a rectifier and a power factor correction (PFC) circuit, wherein the first circuit is an inverter circuit, the EMI filter receives the AC power source, the rectifier is connected between the EMI filter and the PFC circuit, and the inverter circuit comprises the first switch and receives an output of the PFC circuit.

9. A ballast circuit according to claim 1 further comprising an AC power source, an electromagnetic interference (EMI) filter, a rectifier, a power factor correction (PFC) circuit and an inverter circuit, wherein the first circuit is a DC/DC converter having the first switch, the EMI filter receives the AC power source, the rectifier is connected between the EMI filter and the PFC circuit, the DC/DC converter receives an output of the PFC circuit and the inverter circuit receives an output of the DC/DC converter.

10. A ballast circuit according to claim 9, wherein the DC/DC converter is a buck converter and the inverter circuit is a full-bridge inverter.

11. A controlling method for a ballast circuit supplying power to a discharge lamp, wherein the ballast circuit comprises a first circuit having a first switch, and a controller circuit comprising a first controller and a voltage sensing apparatus, comprising steps of:

causing the first controller to generate a first driving signal so as to control the first switch;

causing the voltage sensing apparatus to receive the first driving signal and generate a sensed voltage representing a duty ratio of the first driving signal reflecting the discharge lamp voltage; and switching operating modes of the discharge lamp according to the sensed voltage.

12. A controlling method according to claim 11, wherein the switching step further comprising a step of:

working under a constant power mode when the sensed voltage is larger than a first predetermined value.

13. A controlling method according to claim 11, wherein the switching step further comprising a step of:

turning off the discharge lamp when the sensed voltage is larger than a second predetermined value.

14. A controlling method according to claim 11, wherein the switching step further comprising a step of:

working under a constant current mode when the sensed voltage is smaller than a third predetermined value.

15. A controlling method according to claim 14, wherein the third predetermined value equals to the first predetermined value.

16. A controlling method according to claim 11, wherein the signal reflects a lamp voltage of the discharge lamp and the first controller is a digital controller.

17. A controlling method according to claim 11 further comprising a step of:

causing the driver to generate a second and a third driving signals to drive the first and the second switches respectively.

18. A controlling method according to claim 11 further comprising a step of:

causing the driver to generate a second and a third driving signals to drive the first and the second switches respectively.

19. A ballast circuit supplying power to a discharge lamp system, comprising:

a first circuit having a switch;

a first controller generating a first driving signal and controlling the switch accordingly; and a voltage sensing apparatus receiving the first driving signal and generating a sensed voltage accordingly, wherein the sensed voltage reflects a discharge lamp voltage and the discharge lamp switches among a plurality of operating modes according to the sensed voltage.

* * * * *